United States Patent [19]

Marchadour

[11] Patent Number: 4,501,622

[45] Date of Patent: Feb. 26, 1985

[54] APPARATUS AND METHOD FOR CLEANING FLOWABLE MATERIAL FILLING DEVICES

[76] Inventor: Jean-Charles Marchadour, "La Feuilleraie" Kerbascol, St. Jean Trolimon, France

[21] Appl. No.: 549,788

[22] Filed: Nov. 8, 1983

[51] Int. Cl.[3] ..... B08B 3/02

[52] U.S. Cl. ..... 134/18; 134/22.18; 134/23; 134/33; 141/90; 141/91

[58] Field of Search ..... 134/18, 22.18, 23, 33, 134/56 R, 57 R, 58 R, 59, 140, 146, 151, 152, 165, 170, 171; 141/89, 90, 91, 146

[56] References Cited

U.S. PATENT DOCUMENTS

| | | | |
|---|---|---|---|
| 1,254,190 | 1/1918 | Baker | 141/146 X |
| 2,961,013 | 11/1960 | Johnson | 141/146 X |
| 2,998,037 | 8/1961 | Bingham | 141/146 X |
| 3,568,734 | 3/1971 | Vadas et al. | 141/89 |

*Primary Examiner*—Marc L. Caroff

*Attorney, Agent, or Firm*—Thorpe, North & Western

[57] ABSTRACT

Apparatus for cleaning a flowable material filling device composed of a hopper for holding the material, a plurality of spaced-apart assemblies, each of which includes a cylinder into which material flows from the hopper and a piston movable in the cylinder to force material from the cylinder into containers, and a piston support structure for causing the pistons to move in the cylinders. The apparatus includes a lifting mechanism coupled to the piston support structure and responsive to a first signal for moving the piston support structure in a first direction to thereby move the pistons out of the cylinders, and responsive to a second signal for moving the piston support structure in a second direction to thereby move the pistons back into the cylinders. Valve controlled liquid spray nozzles are positioned to spray liquid into the cylinders and against the pistons when they are removed from the cylinders in response to a third signal. A control unit automatically supplies the first, second and third signals to control the lifting mechanism and the valves.

9 Claims, 2 Drawing Figures

APPARATUS AND METHOD FOR CLEANING FLOWABLE MATERIAL FILLING DEVICES

BACKGROUND OF THE INVENTION

This invention relates to apparatus and method for automatically cleaning devices which are used for filling containers with flowable food materials such as liquid, semi-liquid or pasty products.

Apparatus and processes for automatically filling containers such as cans with both food and non-food products have become very sophisticated. Such apparatus and processes are used to fill containers with liquid, semi-liquid, pasty or solid products including both food products such as liver paste, baby foods, jellys, vegetable oil, mustard, sauces, etc., and non-foods such as mineral oil, wax, paints, etc. It is important, especially when filling containers with food products, that the apparatus used be appropriately cleaned and sanitized. Cleaning and sanitation is typically required after use of the apparatus for some predetermined period of time to can one product, or after completion of canning of one product and before beginning the canning of a different product.

The manner in which flowable material filling devices are cleaned and sanitized would depend in part on the structure of the devices. Such devices may take a variety of forms, one of the most popular of which is the so-called rotary piston filler such as the MR 16, MR 22 and MR 30 units manufactured by Hema International, Inc. of Utah. Rotary fillers typically include a generally cylindrical hopper made, for example, of stainless steel, a number of filling assemblies spaced apart about the exterior of the hopper, and a container or can conveying system for moving cans into position underneath the filling assemblies to receive product. The filling assemblies each typically includes a vertically disposed cylinder, a valve coupling the lower end of the cylinder to the hopper and operable to either allow material to flow from the hopper into the cylinder or to flow from the cylinder into a can positioned below the valve, and a piston movable in the cylinder to force material from the cylinder into the can. Rotary fillers also typically include a piston support structure for causing the pistons to move upwardly in the cylinders when product is flowing from the hopper into the cylinders, and downwardly when product is being forced from the cylinder into cans.

Cleaning of rotary fillers in the past has involved the manual removal of each of the pistons from its respective cylinder so that both the piston and the interior of the cylinder are exposed, spraying the cylinders, pistons, valves and hopper interior with some type of sanitizing liquid, and then manually replacing the pistons in the cylinders. Such cleaning process is both time consuming and inconsistent in that since everything is done manually, attendants must be present to perform the cleaning and the thoroughness of the cleaning may vary from one time to the next.

SUMMARY OF THE INVENTION

It is an object of the invention to provide apparatus and method for automatically cleaning devices which are used to fill containers or cans with flowable material.

It is another object of the invention to provide such apparatus and method for efficiently, rapidly and thoroughly cleaning flowable material filling devices.

The above and other objects of the invention are realized in a specific illustrative embodiment thereof which may be utilized for cleaning a flowable material filling device composed of a hopper for holding the material, a plurality of spaced-apart filling assemblies, each of which includes a cylinder into which material flows from the hopper and a piston movable in the cylinder to force material from the cylinder into containers, and a piston support structure for causing the pistons to move in the cylinders. The cleaning apparatus includes a lifting mechanism coupled to the piston support structure and responsive to a first signal for moving the piston support structure in a first direction to thereby move the pistons out of the cylinders, and responsive to a second signal for moving the piston support structure in a second direction to thereby move the pistons back into the cylinders. Also included are valve controlled liquid spray nozzles positioned to spray liquid into the cylinders and against the pistons when they are removed from the cylinders, all in response to a third signal, and a control unit for automatically supplying the first and second signals to the lifting mechanism and the third signal to valves controlling the liquid spray nozzles.

Advantageously for rotary fillers, the spray nozzles are disposed in a fixed position so that the hopper and filling assemblies may be rotated past the nozzles while the nozzles are spraying the cleaning liquid. The process for cleaning the material filling devices would then involve the steps of automatically moving the pistons out of the cylinders, operating the spray nozzle valves to allow the nozzles to spray the cleaning liquid, and operating a drive motor to cause the hopper and filling assemblies to rotate past the spray nozzles so that the liquid is sprayed onto the pistons and into the cylinders to perform the cleaning task.

In accordance with one aspect of the invention, a spray nozzle is disposed inside the hopper to spray cleaning liquid against the interior walls of the hopper.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
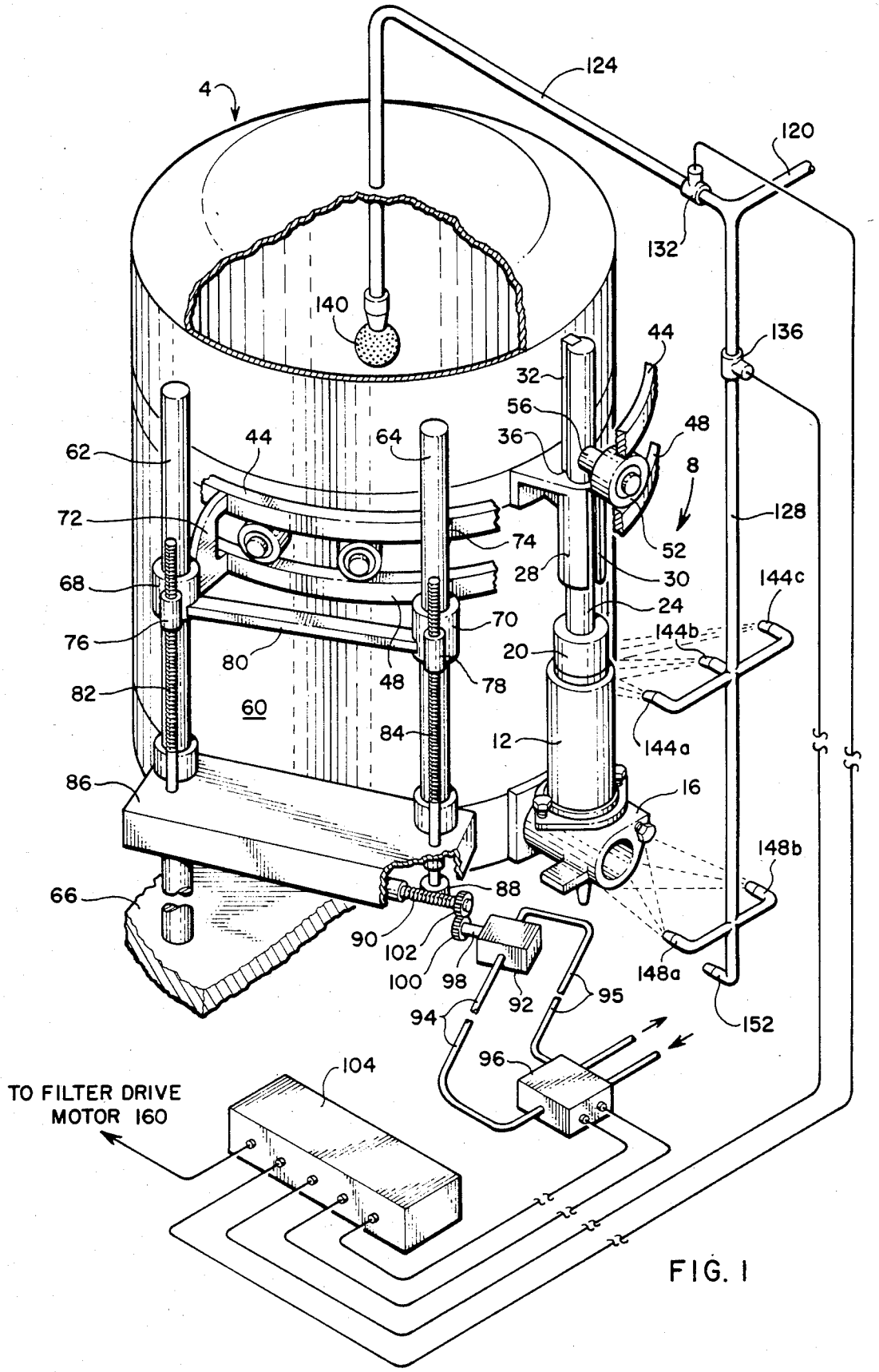
FIG. 1 shows a perspective, partially cut-away, and fragmented view of cleaning apparatus made in accordance with the principles of the present invention.

Referring to the drawings, there is shown apparatus for automatically cleaning a conventional rotary filler of the type such as manufactured by Hema International, Inc. The rotary filler includes a generally cylindrical hopper 4 mounted to rotate about its cylindrical axis. The hopper is for holding flowable material such as baby foods, vegetable oil, wax, paints, etc., which is to be dispensed into containers.

Figure 2:
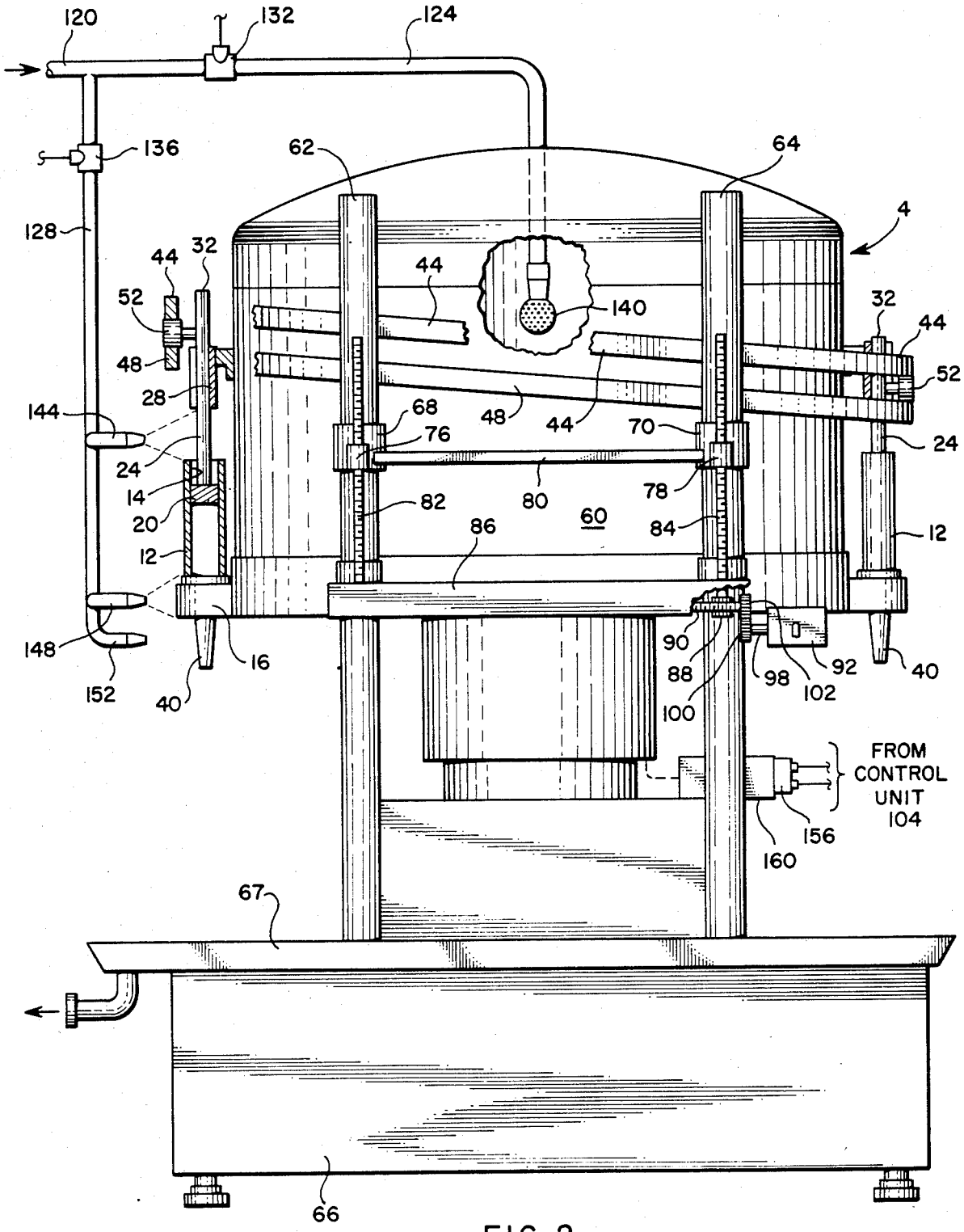
FIG. 2 is a side, partially cut-away, fragmented elevational view of the apparatus of FIG. 1.

Mounted on the exterior of the hopper 4 are a plurality of spaced-apart filling assemblies 8, only one of which is shown in FIG. 1 and two of which are shown in FIG. 2. Each filling assembly includes a so-called dosing cylinder 12 mounted onto a filling valve 16 so that the axis of the cylinder 12 is oriented to be generally vertical. The valve 16 is mounted on the side of the hopper 4 to communicate with the interior thereof. In particular, the valve 16 may be operated to allow material contained in the hopper 4 to flow into the cylinder 12 or to allow material in the cylinder 12 to flow downwardly through the valve into a container or can disposed below the valve. The filling assembly 8 also includes a piston 20 mounted on the lower end of a piston rod 24 which, in turn, is slidably mounted in a piston guide sleeve 28. The piston guide sleeve 28 is mounted on the side of the hopper 4 to hold the piston rod 24 in a generally vertical orientation so that the axis of the rod is colinear with the axis of the cylinder 12. The piston rod 24 includes an elongate key 32 which fits into an elongate groove 36 formed in the sleeve 28 to prevent the piston rod from rotating in the sleeve. The piston guide sleeve 28 allows the piston rod 24 to move upwardly or downwardly to enable removal of the piston 20 from the cylinder 12 and reinsertion of the piston into the cylinder. FIG. 1 shows the piston 20 completely removed from the cylinder 12, while FIG. 2 shows the piston in place within the cylinder. A spout 40 (FIG. 2) extends downwardly from the valve 16 to guide material flowing from the cylinder and through the valve into a container or can disposed under the filling assembly. The conveyor system for positioning containers or cans under the filling assemblies is not shown since it forms no part of the present invention.

The pistons 20 are caused to move in the cylinders 12 to alternately allow material to flow into the cylinders from the hopper and then from the cylinders into cans located under the valves 16. The movement of the pistons 20 takes place automatically as the hopper and filling assemblies are rotated. The structure for controlling this movement of the pistons includes a pair of tracks 44 and 48 which form ramps encircling the hopper 4. The tracks 44 and 48 are spaced apart a fixed distance to receive therebetween rollers such as roller 52 which is mounted to rotate on an axle 56 which extends outwardly from the piston rod 24. The tracks 44 and 48 slope as they encircle the hopper 4, as best seen in FIG. 2, so that as the hopper and filling assemblies 8 are rotated, rollers 52 roll within the tracks 44 and 48 to move upwardly or downwardly as determined by the tracks. As the rollers 52 are caused to move upwardly or downwardly, they cause the corresponding piston rod 24 and piston 20 to move upwardly or downwardly in the corresponding cylinder 12. Thus, when the cylinder 12 is being filled, the corresponding roller 52 is moving upwardly within the tracks 44 and 48 to raise the piston 20, and when the cylinder 12 is being discharged of its contents, the roller 52 is moving downwardly within the tracks to cause the piston 20 to move downwardly and force the material from the cylinder. An elongate opening 30 in the front of the piston guide sleeve 28 accommodates vertical movement of the axle 56. All of the above is conventional structure.

The apparatus of the present invention includes a pair of lifting mechanisms 60 located on opposite sides of the hopper 4 by which the tracks 44 and 48 may be lifted or lowered to thereby lift the pistons out of the cylinders for cleaning and then lower the pistons back into the cylinders. Each lifting mechanism includes a pair of spaced apart, generally vertically oriented support posts 62 and 64 which extend upwardly from a base 66. A pair of collars 68 and 70 are slidably fitted over posts 62 and 64 respectively, and a pair of braces 72 and 74 connect the collars 68 and 70 respectively to the tracks 44 and 48. A pair of threaded sleeves 76 and 78 are mounted on the sides of collars 68 and 70 respectively so that the sleeve openings are generally vertically oriented. A brace 80 extends between the collar 68 and sleeve 76 and the collar 70 and sleeve 78. The openings in the sleeves 76 and 78 are threaded to screwably receive worm screws 82 and 84 respectively. The worm screws 82 and 84 extend downwardly to a platform 86 in which the screws are rotatably mounted. The platform 86, in turn, is rigidly mounted on the posts 62 and 64. Each of the worm screws 82 and 84 includes a wheel gear such as wheel gear 88 mounted at the lower end of worm screw 84. As the wheel gear 88 is turned, so also is the worm screw 84. As the worm screws 82 and 84 are rotated, the sleeve 76 and 78 and thus the collars 68 and 70 are caused to move either upwardly or downwardly, depending upon the direction of rotation of the worm gears, to thus carry the tracks 44 and 48 either upwardly or downwardly. By moving the tracks 44 and 48 upwardly a predetermined distance, the rollers 52 will be carried upwardly to raise the pistons 20 up and out of the corresponding cylinders 12.

Rotation of the worm screws 82 and 84 is effectuated by a third worm screw 90 which is rotatably mounted under the platform 86 to mesh with the two wheel gears mounted at the lower ends of the worm screws 82 and 84. Thus, when the worm screw 90 is caused to rotate, the two worm screws 82 and 84 are likewise caused to rotate in a well known manner. Rotation of the worm screw 90 is controlled by a hydraulic motor 92 which is coupled by way of conduits 94 and 95 to a bi-directional valve 96. The valve 96, in turn, is coupled to a source of hydraulic fluid which is not shown. The hydraulic motor 92 includes a shaft 98 on the end of which is mounted a wheel gear 100 which is positioned in driving relationship with a wheel gear 102 mounted on the end of worm screw 90. Operation of the hydraulic 92 is under the control of a control unit 104 which produces various control signals for general control of the operation of the cleaning apparatus of the present invention. The hydraulic motor 92 is controlled by the control unit 104 operating the valve 96 to allow hydraulic fluid to flow to the motor either through conduit 94 or through conduit 95 to cause the motor to operate in either the forward or backward directions. Thus, the hydraulic motor 92 can be controlled to rotate worm screw 90 in either direction to thereby cause the raising or lowering of the tracks 44 and 48 and thus the raising or lowering of pistons 20.

Cleaning of the rotary filler would be initiated by raising the pistons out of the corresponding cylinders so as to expose the pistons and cylinders to a spray of cleaning liquid. After cleaning, the pistons would again be lowered into place in the cylinders. To facilitate complete automation of this process, it is important that the pistons remain properly aligned with the cylinders during removal and reinsertion of the pistons in the cylinders. For this reason, piston guide sleeve 28 (and the other guide sleeves) is elongated to more precisely maintain the alignment of the piston 20 with the cylinder 12. It has been found advantageous to provide the piston guide sleeve 28 which has a length which is about $\frac{1}{4}$ or greater the distance over which the piston 20 may be moved. To facilitate reinsertion of the piston 20 into the cylinder 12, the upper interior walls 14 of the cylinder are formed to slope or taper outwardly as best seen in FIG. 2. Thus, some misalignment of the piston 20 with the cylinder 12 can be accommodated when the piston is being reinserted into the cylinder.

The cleaning liquid spraying apparatus of the embodiment of the drawings includes a conduit 120 for conveying cleaning liquid under pressure from a source (not shown). The conduit 120 divides into two branches 124 and 128 in which are installed electrically controlled valves 132 and 136 respectively. Conduit branch 124 extends through the top wall of the hopper 4 into the interior thereof. A spray nozzle 140 is mounted on the end of the conduit branch 124 to spray cleaning liquid in all directions inside the hopper 4 to clean the interior of the hopper. The control unit 104 signals control valve 132 to selectively and automatically open or close the valve to therby effectuate the cleaning of the hopper.

The conduit branch 128 extends downwardly along the side of the hopper 4 and includes three spray nozzles 144*a*, 144*b* and 144*c* spaced apart horizontally and directed to spray liquid cleaner against the pistons 20 which have been removed from their cylinders, and into the cylinders. The conduit branch 128 also includes spray nozzles 148*a* and 148*b* spaced apart horizontally at a location below nozzles 144*a*, 144*b* and 144*c*. The nozzles 148*a* and 148*b* are directed toward the valve 16 to clean the exterior thereof and, if the valve has been opened, the interior. A nozzle is connected to the end of conduit branch 152 at a location below nozzles 148*a* and 148*b*, and is directed toward spout 40 (FIG. 2) to spray liquid cleaner thereagainst. The flow of liquid cleaner to nozzles 144, 148 and 152 is controlled by valve 136 in response to signals received from the control unit 104. Excess liquid cleaner falls downwardly into a collecting pan 67 (FIG. 2) from which it is drained.

An exemplary sequence of operation for cleaning the rotary filler of the drawings could include the steps of the control unit 104 signalling the valve 96 to allow hydraulic fluid to flow to the motor 92 to cause the motor to operate the lifting mechanism 60 to lift the pistons 20 from the cylinders 12, the control unit signalling the control valves 132 and 134 to allow cleaning fluid to flow to the spray nozzles, the control unit signalling a switch 156 of a drive motor 160 (FIG. 2) of the rotary filler to cause the rotary filler with filling assemblies 8 to rotate past the spray nozzles, and then after a suitable time the control unit signalling the drive motor switch and control valves 132 and 136 to respectively stop rotation of the rotary filler and stop the flow of cleaning fluid. Finally the control unit 104 would signal the valve 96 to allow hydraulic fluid to flow in the opposite direction to the motor 92 to cause the motor to operate the lifting mechanisms 60 to lower the pistons 20 back into the cylinders 12.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Apparatus for cleaning a flowable material filling device which comprises a hopper for holding the material, a plurality of spaced apart filling assemblies, each of which includes a cylinder into which material flows from the hopper and a piston movable in the cylinder to force material from the cylinder into containers, and piston support means for causing the pistons to move in the cylinders, said apparatus comprising lifting means coupled to the piston support means and responsive to a first signal for moving the piston support means in a first direction to thereby move the pistons out of the cylinders, and responsive to a second signal for moving the piston support means in a second direction to thereby move the pistons into the cylinders, liquid spray means disposed to spray liquid against pistons which are moved out of the cylinders and into the cylinders, in response to a third signal, and control means for automatically supplying the first and second signals to the lifting means and the third signal to the liquid spray means.

2. Apparatus as in claim 1 wherein said cylinders are oriented to be generally vertical, and said lifting means is adapted to move the piston support means upwardly to lift the pistons out of the cylinders, and downwardly to insert the pistons into the cylinders.

3. Apparatus as in claim 2 wherein said cylinders are formed with interior walls which slope outwardly at the tops thereof to facilitate insertion of the pistons into the cylinders.

4. Apparatus as in claim 3 wherein each filling assembly of the flowable material filling device further includes a valve located at the bottom of the corresponding cylinder to interconnect the cylinder with the hopper, and a downwardly directed spout mounted on the bottom of the valve, said valve being operable in one position to allow material to flow from the hopper into the cylinder, and in another position to allow material to flow, upon downward movement of the corresponding piston, from the cylinder through the spout into a container, and wherein said liquid spray means comprises first nozzle means disposed to spray liquid against the pistons and into the cylinders, second nozzle means disposed to spray liquid against the valves, and third nozzle means disposed to spray liquid against the spouts.

5. Apparatus as in claim 4 wherein said flowable material filling device is a rotary filler in which the filling assemblies are mounted about the side exterior of the hopper, and the hopper and assemblies are adapted to rotate in response to a fourth signal, wherein the first, second and third nozzle means are disposed in fixed positions so that the cylinders, valves and spouts rotate past the first, second and third nozzle means as the hopper and filling assemblies are rotated, and wherein said control means automatically supplies the fourth signal to the rotary filler.

6. Apparatus as in claim 5 wherein said liquid spray means further comprises a fourth nozzle means suspended within the hopper and responsive to a fifth signal for spraying liquid against side walls and bottom wall of the hopper, and wherein said control means automatically supplies the fifth signal to the fourth nozzle means.

7. Apparatus as in claim 2 wherein said flowable material filling device is a rotary filler in which the filling assemblies are mounted about the side exterior of a generally cylindrical hopper, and the hopper and assemblies are adapted to rotate, said filling assemblies each further including an elongate piston rod, the lower end of which is joined to a corresponding piston to support the piston, and a piston guide sleeve mounted on the side exterior of the hopper to slidably receive the piston rod, said piston guide sleeve being of a length about one-fourth or greater the distance over which the piston may be moved.

8. Apparatus as in claim 7 wherein said lifting means comprises first and second lift mechanisms disposed on opposite sides of the hopper, each lifting mechanism including a base, a pair of spaced-apart, generally vertically oriented support posts extending upwardly from the base, a pair of collars, each slidably fitted over a respective post, a pair of braces, each joining a respective collar to the piston support means, a pair of threaded sleeves, each attached to a respective collar and each oriented with its opening in a generally vertical alignment, a pair of threaded worm screws, each of which is screwed into a respective sleeve and rotatably mounted in fixed relation to a respective post, and each of which includes a wheel gear at one end thereof so that when the wheel gears are rotated, the worm screws will rotate to thereby cause the sleeves and thus the collars to move upwardly or downwardly on the posts, a third threaded worm screw rotatably mounted to contact and cause the wheel gears to rotate as the third worm screw is rotated, and drive means responsive to said first signal for rotating the third worm screw in a first direction to cause the raising of the piston support means, and responsive to said second signal for rotating the third worm screw in a second direction to cause the lowering of the piston support means.

9. A process for cleaning a rotary flowable material filling device which has a hopper for holding the material, a plurality of spaced-apart filling assemblies mounted about the side exterior of the hopper, and a drive mechanism responsive to a signal for causing the hopper and filling assemblies to rotate, wherein each filling assembly includes a cylinder into which material flows from the hopper and a piston movable in the cylinder to force material from the cylinder into containers, said process including the steps of automatically operating a lifting mechanism coupled to the pistons to raise the pistons out of their respective cylinders, activating a spraying mechanism to spray cleaning liquid against the pistons, into the cylinders, and into the hopper, automatically operating a drive motor to cause the hopper and filling assemblies to rotate past the spraying mechanism, deactivating the spraying mechanism to terminate spraying of the pistons, cylinders and hopper, automatically terminating the operation of the drive motor, and automatically operating the lifting mechanism to lower the pistons back into their respective cylinders.

* * * * *